United States Patent [19]

Bihn

[11] Patent Number: 4,712,739

[45] Date of Patent: Dec. 15, 1987

[54] SPRAY GUN NOZZLE ASSEMBLY RETAINER CLIP AND SPRAY GUN NOZZLE ASSEMBLY

[75] Inventor: Raymond J. Bihn, Oregon, Ohio

[73] Assignee: Champion Spark Plug Company, Toledo, Ohio

[21] Appl. No.: 915,307

[22] Filed: Oct. 3, 1986

[51] Int. Cl.[4] ..... B05B 15/06

[52] U.S. Cl. ..... 239/290; 239/600

[58] Field of Search ..... 239/290, 295, 296, 297, 239/298, 600; 403/292, 293, 377; 285/345, 921

[56] References Cited

U.S. PATENT DOCUMENTS

| | | | |
|---|---|---|---|
| 1,871,668 | 1/1929 | Dawson | 403/377 |
| 2,630,857 | 2/1951 | Cohen | 403/292 |
| 2,860,010 | 9/1955 | Sennstrom et al. | 239/600 |
| 4,135,745 | 1/1979 | Dehar | 285/921 |
| 4,478,370 | 10/1984 | Hastings | 239/296 |

*Primary Examiner*—Andres Kashnikow
*Assistant Examiner*—Karen B. Merritt
*Attorney, Agent, or Firm*—MacMillan, Sobanski & Todd

[57] ABSTRACT

A clip for frictionally holding an air cap or a fluid tip on a spray gun when a retainer ring is removed and an improved nozzle assembly including the clip. For an air atomization type spray gun, the clip is positioned in a chamber defined between the air cap and the fluid tip for frictionally engaging both the air cap and the fluid tip. For an air assisted airless spray gun, the clip holds the fluid tip on the end of the barrel. The clip temporarily holds the air cap or the fluid tip in place when a retainer ring is removed during assembly or disassembly of the nozzle assembly.

10 Claims, 3 Drawing Figures

SPRAY GUN NOZZLE ASSEMBLY RETAINER CLIP AND SPRAY GUN NOZZLE ASSEMBLY

TECHNICAL FIELD

The invention relates to liquid spray guns and more particularly to a clip for frictionally holding a spray gun air cap on a fluid tip when the air cap retainer ring is removed or for frictionally holding a fluid tip on a spray gun barrel when the retainer ring is removed and to a spray gun nozzle assembly incorporating the clip.

BACKGROUND ART

In a typical air atomization type spray gun, paint or other liquid coating material is discharged under pressure through an orifice in a fluid tip. The liquid orifice is surrounded by an annular opening defined between the fluid tip and an air cap. Compressed air supplied to the air cap discharges through the annular opening for atomizing the discharged liquid. The air cap also normally includes other orifices for discharging supplementary air jets for enhancing atomization and for controlling and shaping the spray pattern. Typically, the fluid tip is attached to the end of the spray gun barrel. The air cap is positioned over the fluid tip and an annular retainer ring is positioned over the air cap and screwed to the end of the barrel to retain the air cap on the barrel.

During use of the spray gun, it is sometimes necessary to remove the air cap to service the spray gun. For example, it may be necessary to clean or to change the fluid tip. In an industrial application, the spray gun is often attached either to a fixed mount or to a reciprocator or even to an industrial robot located in a spray booth. The spray gun may be mounted to point in a downward direction. When the air cap retainer ring is removed, the loose air cap may fall if the operator is not careful. Many industrial spray booths have a grate on the floor. If the air cap is dropped, it may be lost through the grate or it may be damaged. In either case, loss or damage to the air cap results in added operating expense and increased down time for the spray equipment.

Similar problems may occur with servicing other types of spray gun nozzles. For example, in an air assisted airless atomization type spray gun, a fluid tip and an air cap are free to fall when a retainer ring is removed during disassembly and assembly.

DISCLOSURE OF INVENTION

The invention is directed to a clip for frictionally holding an air cap and/or a fluid tip on a spray gun when a retainer ring which normally holds the air cap and/or fluid tip is removed, and to a nozzle assembly including the clip. For an air atomization type spray gun, the clip has an inner surface which engages a surface on the fluid tip in an air chamber located between the fluid tip and the air cap. The clip further has generally radially directed fingers which frictionally engage an inner surface on the air cap. The fingers are spaced to allow free passage of atomization air through the chamber to the annular atomization air opening. The fingers are sufficiently resilient to allow the air cap to center on the fluid tip when the retainer ring is attached to the spray gun barrel. The clip dimensions are selected to provide greater retention force between the clip and the fluid tip than between the clip and the air cap so the clip will stay on the fluid tip when the air cap is pulled free.

In operation, the retainer ring can be removed from the spray gun barrel without risk of dropping the air cap, even when the spray gun is pointed in a downward direction. The clip allows the operator to simply pull the air cap free from the fluid tip after the retainer ring is removed.

Accordingly, it is an object of the invention to provide a clip for a spray gun for retaining an air cap on a fluid tip when an air cap retainer ring is removed during maintenance.

Another object of the invention is to provide a spray gun nozzle assembly including a clip for frictionally holding an air cap and or fluid tip on the gun when an air cap retainer ring is removed.

Other objects and advantages of the invention will be apparent from the following description and the accompanying drawings.

BEST MODE FOR CARRYING OUT THE INVENTION

Figure 1:
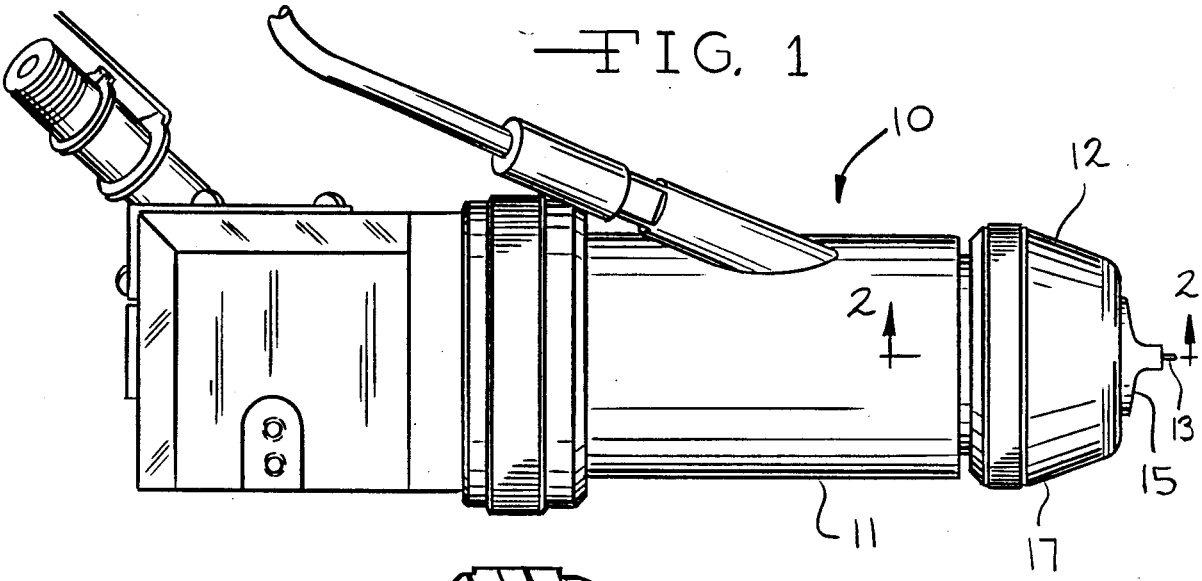
FIG. 1 is a side elevational view of an exemplary air atomization spray gun incorporating an air cap retainer clip according to the invention.

Referring to FIG. 1 of the drawings, an exemplary air atomization spray gun 10 is shown. The spray gun 10 is of a type which may be mounted in an industrial spray booth on either a fixed mount, a reciprocator or on an industrial robot. The spray gun 10 has a barrel 11 to which a nozzle assembly 12 is attached. Paint or other coating liquid and atomization air are supplied through the barrel to the nozzle assembly 12 in a conventional manner. The illustrated spray gun 10 is of the electrostatic type and includes an electrode 13 projecting from the nozzle assembly 12 for imparting a charge to the atomized coating liquid. It will be appreciated that the illustrated spray gun 10 is only exemplary and that the invention is equally applicable to other types of air atomization spray guns both of the electrostatic and the non-electrostatic type.

Figure 2:
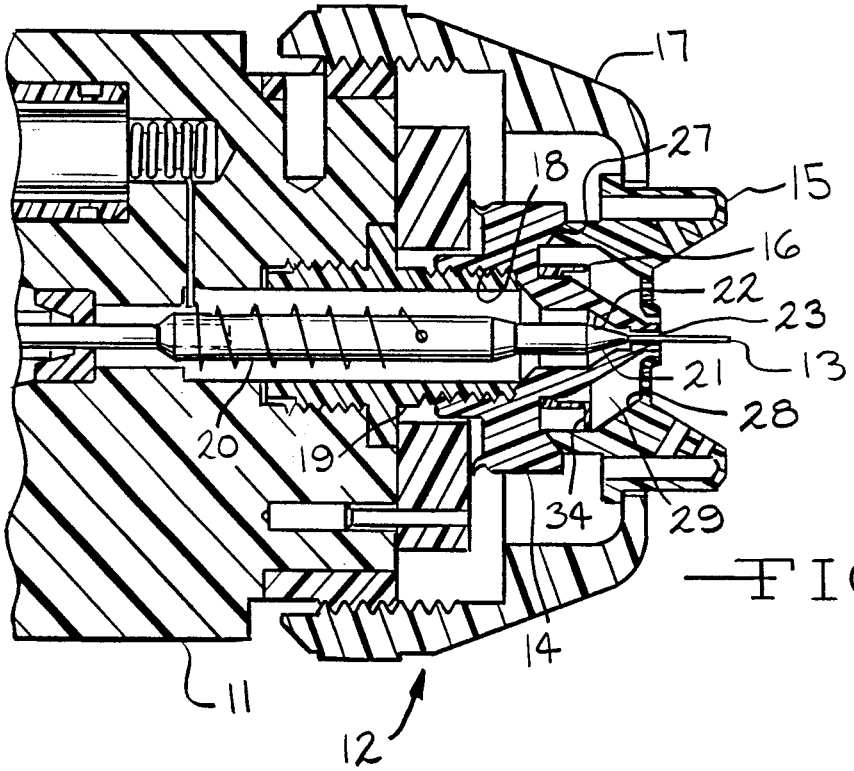
FIG. 2 is an enlarged cross sectional view taken along line 2—2 of FIG. 1.
Figure 3:
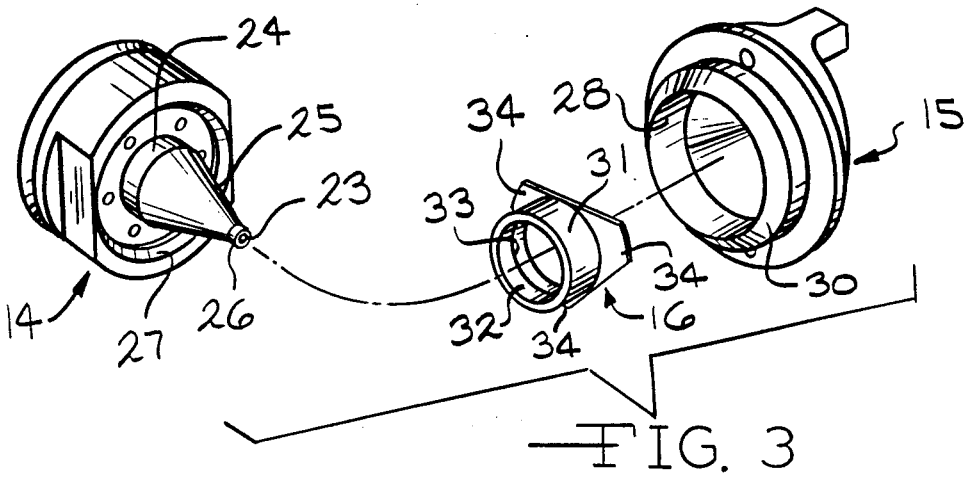
FIG. 3 is an exploded perspective view of the fluid tip, the retainer clip and the air cap of FIG. 2.

FIGS. 2 and 3 show details of the nozzle assembly 12, and particularly of a fluid tip 14, an air cap 15, a clip 16 according to the invention, and an air cap retainer ring 17. The fluid tip 14, the air cap 15 and the retainer ring 17 are of conventional design. The fluid tip 14 has a thread 18 which is attached through a threaded insert 19 to the spray gun barrel 11. A valve needle 20 extends into the fluid tip 14 and has a tapered surface 21 which seats against an interior surface 22 in the fluid tip 14 to form a coating liquid control valve. The electrode 13 extends from the needle 20 coaxially through a liquid discharge orifice 23 at the front of the fluid tip 14.

The exterior of the fluid tip 14 includes a cylindrical surface 24. From the cylindrical surface 24, a conical surface 25 extends inwardly to a thin walled tubular end 26 which defines the discharge orifice 23. A conical surface 27 is provided for centering the air cap 15 over the fluid tip 14.

The air cap 15 has an interior opening 28 which is larger in diameter than the cylindrical surface 24 and the conical surface 25 for defining an annular chamber 29 when the air cap 15 is positioned over the fluid tip 14.

At its rear edge, the air cap 15 has a conical surface 30 located to abut the conical fluid tip surface 27 to align the air cap coaxially with the fluid tip 14 when the retainer ring 17 is attached to the barrel 11. Normally, the retainer ring 17 is the only means of attachment between the air cap 15 and the barrel 11. Thus, when the retainer ring 17 is removed, the air cap 15 is free to fall.

According to the invention, the clip 16 is provided to frictionally hold the air cap 15 on the fluid tip 14 when the retainer ring 17 is removed. The clip 16 is made from a resilient material such as a synthetic resinous material and, preferably, is of a non-conductive material when the clip 16 is used in an electrostatic coating system. The clip 16 has a tubular body 31 defining a central opening 32. The innermost diameter of the opening 32 is slightly smaller that the diameter of the cylindrical fluid tip surface 24 to provide an interference fit so that the clip 16 will be retained on the fluid tip 14 through friction. Preferably, the clip opening 31 has an inwardly directed step or ridge 33 which provides a thicker body wall for engaging the fluid tip surface 24 and a thinner body wall to the front of the fluid tip surface 24. The thinner wall reduces stresses in the clip 16 which might tend to force the clip 16 from the fluid tip 14. The clip 16 is formed of a sufficiently elastic material to permit pressing the clip body 31 onto the cylindrical fluid tip surface 24. The clip may be formed, for example, from an acetyl such as Delrin, from a polypropylene or from Nylon.

In the broadest scope of the invention, the clip 16 may be attached to the fluid tip by other methods, such as by a bayonet connection (not shown). Or, an annular groove may be formed around the periphery of the surface 24 for receiving a complementary ridge or shoulder formed in the clip opening 32. Thus, when the clip is pressed over the fluid tip, it will snap in place.

Several spaced fingers 34 project substantially radially outwardly from the clip body 31 for frictionally engaging the wall of the air cap opening 28. Preferably, there are three or more flat fingers 34 which extend outwardly from the body 31 to engage the wall of the air cap opening 28 about a circumference, thereby increasing the finger holding ability. The three fingers 34 facilitate centering the air cap 15 over the fluid tip 14. Also, it is preferable to have the fingers 34 engage the air cap 15 with less force than the clip 16 engages the fluid tip 14. The fingers 34 may slope slightly towards the spray gun barrel 11 to reduce the force required to push the air cap 15 over the fluid tip 14. The fingers 34 are spaced apart around the body 31 to provide sufficient atomization air flow passages between the clip 16 and the air cap 15.

In use, the clip 16 is pressed on the fluid tip 14 prior to attaching the air cap 15 to the barrel 11. The Air cap 15 then is attached in the normal manner, except that a small force is required to push the air cap 15 over the clip 16 on the fluid tip 14. When the retainer ring 17 is later removed for maintenance on the spray gun 10, the air cap 15 is held in place by the clip 16, even when the spray gun is pointed down. The operator merely pulls the air cap 15 from the fluid tip 14 to expose the fluid tip 14 for maintenance.

The clip 16 is equally useful for temporarily holding a fluid tip and/or an air cap on the end of a barrel of an air assisted airless spray gun during maintenance. Depending upon the details of the spray gun design, the clip is attached to any convenient point on the gun barrel. The clip frictionally engages either an air cap or a fluid tip which is clamped between the a cap and the barrel to retain the cap and/or the fluid tip during disassembly and assembly of the spray gun.

I claim:

1. A spray gun assembly including a spray gun barrel defining at least one fluid passage and having an end, a cap positioned over said barrel end, said cap having an interior surface spaced from an exterior surface on said barrel end to form a chamber, removable means engaging said barrel for retaining said cap on said barrel end, and a clip frictionally holding said cap on said barrel end, said clip comprising a tubular body, means for attaching said clip body to said barrel end, said spray gun having at least one fluid passage extending through said barrel, said clip and said cap, and holding means projecting from said body for frictionally engaging said interior cap surface while permitting easy removal of said cap from said barrel when said retaining means is removed from said barrel.

2. The spray gun assembly of claim 1, wherein said holding means comprises three resilient fingers uniformly spaced around and projecting substantially radially from said body for engaging the interior cap surface.

3. The spray gun assembly of claim 2, wherein said fingers are flat and extend from said body to engage the interior cap surface about a circumference.

4. The spray gun assembly of claim 1, wherein said clip is formed from a resilient material, and wherein said means for attaching said clip to the barrel end comprises an interior surface in said tubular body having a dimension for frictionally engaging the exterior barrel end surface.

5. The spray gun assembly of claim 4, wherein said means for attaching said clip to the barrel end retains said clip on the barrel end with greater force than said holding means engage the cap whereby, when the cap is pulled from the barrel end, said clip stays on the barrel end.

6. A nozzle assembly for an air atomization liquid spray gun comprising a fluid tip having a liquid discharge orifice and having an exterior surface, an air cap positioned coaxially over said fluid tip, said air cap having an interior surface located to define an atomization air chamber with said exterior fluid tip surface, an annular atomization air discharge opening surrounding said orifice defined between said fluid tip and said air cap and connected to said chamber, removable retainer ring means for releasably attaching said air cap to said spray gun, and clip means for frictionally holding said air cap on said fluid tip when said retainer ring means is removed from said spray gun.

7. The spray gun nozzle assembly of claim 6, wherein said clip means includes first means for frictionally engaging said fluid tip and second means for frictionally engaging said air cap with less force than said first means engages said fluid tip whereby, when said retainer ring means is removed from said spray gun and said air cap is pulled from said fluid tip, said clip means stays on said fluid tip.

8. The spray gun nozzle assembly of claim 7, wherein said clip means includes a tubular body, and wherein said second means for frictionally engaging said air cap comprises three resilient fingers uniformly spaced around and projecting from said body for engaging an interior surface in said air cap.

9. The spray gun nozzle assembly of claim 8, wherein said fingers are generally flat and extend from said body to engage the interior air cap surface about a circumference.

10. The spray gun nozzle assembly of claim 7, wherein said clip means is formed from a resilient material, and wherein said first means for frictionally engaging said fluid tip comprises an interior surface in said tubular body having a dimension for frictionally engaging said exterior fluid tip surface.

* * * * *